US009913555B2

(12) United States Patent
Galluzzi

(10) Patent No.: US 9,913,555 B2
(45) Date of Patent: Mar. 13, 2018

(54) MAILBOX WITH DETECTION MEANS

(71) Applicant: ITALMEK S.R.L., Castelfidardo (IT)

(72) Inventor: Settimio Galluzzi, Montefano (IT)

(73) Assignee: ITALMEK S.R.L., Castelfidardo (AN) (IT)

( * ) Notice: Subject to any disclaimer, the term of this patent is extended or adjusted under 35 U.S.C. 154(b) by 0 days.

(21) Appl. No.: 15/318,255

(22) PCT Filed: Jun. 10, 2015

(86) PCT No.: PCT/EP2015/062952
§ 371 (c)(1),
(2) Date: Dec. 12, 2016

(87) PCT Pub. No.: WO2015/193154
PCT Pub. Date: Dec. 23, 2015

(65) Prior Publication Data

US 2017/0105564 A1 Apr. 20, 2017

(30) Foreign Application Priority Data

Jun. 18, 2014 (IT) ..... AN2014A0098

(51) Int. Cl.
*G08B 13/14* (2006.01)
*A47G 29/122* (2006.01)
*A47G 29/126* (2006.01)

(52) U.S. Cl.
CPC ..... *A47G 29/1225* (2013.01); *A47G 29/126* (2013.01); *A47G 2029/1226* (2013.01)

(58) Field of Classification Search
CPC ..... A47G 29/1225; A47G 29/126; A47G 2029/1226
See application file for complete search history.

(56) References Cited

U.S. PATENT DOCUMENTS 3,146,327 A * 8/1964 Ohki ..... H01H 51/287 200/241
3,223,801 A * 12/1965 Cummins ..... H01H 36/006 335/154
3,701,960 A * 10/1972 Campbell ..... H01H 51/28 335/154
3,859,624 A * 1/1975 Kriofsky ..... B07C 3/12 187/391
4,148,019 A * 4/1979 Durkee ..... G08B 25/00 340/521
4,751,499 A * 6/1988 Chen ..... G08B 13/08 340/547

(Continued)

FOREIGN PATENT DOCUMENTS

DE 29515057 U1 1/1996
DE 10119542 A1 10/2002

OTHER PUBLICATIONS

International Search Report for corresponding International Application No. PCT/EP2015/062952.

*Primary Examiner* — Joseph Feild
*Assistant Examiner* — Rufus Point
(74) *Attorney, Agent, or Firm* — Egbert Law Offices, PLLC

(57) ABSTRACT

A mailbox has detection means inside the mailbox to detect the presence of mail and a warning device that is operatively connected to the detection means to inform a user of the presence of mail in the mailbox.

5 Claims, 2 Drawing Sheets

(56) References Cited

U.S. PATENT DOCUMENTS 5,607,103 A * 3/1997 Boling, Jr. ..... A47G 29/1209 232/17
5,818,336 A * 10/1998 Varga ..... A47G 29/1207 232/33
6,028,517 A * 2/2000 Sansone ..... A47G 29/1212 232/34
6,119,622 A * 9/2000 Banerjea ..... A47G 29/1207 116/202
6,474,912 B1 * 11/2002 Meeks ..... B65G 51/26 406/13
6,666,372 B1 * 12/2003 Nagel ..... A47G 29/1209 232/35
6,788,203 B1 * 9/2004 Roxbury ..... A47G 29/1214 232/35
6,980,110 B1 * 12/2005 Hoben ..... A47G 29/1214 340/533
6,995,671 B2 * 2/2006 Dutta ..... A47G 29/1214 232/17
7,061,377 B1 * 6/2006 Kraus ..... A47G 29/1214 340/545.1
7,123,147 B2 * 10/2006 Engel ..... A47G 29/1209 232/35
7,222,779 B1 * 5/2007 Pineda-Sanchez A47G 29/1214 232/36
8,655,795 B1 * 2/2014 Kolchin ..... G06Q 10/04 340/569
9,554,646 B1 * 1/2017 Charette ..... E05B 65/00
2002/0164214 A1 * 11/2002 Meeks ..... B65G 51/26 406/27
2003/0134620 A1 * 7/2003 Dutta ..... A47G 29/1214 455/413
2003/0152480 A1 * 8/2003 Sham ..... A61L 2/202 422/28
2006/0091195 A1 * 5/2006 Fletcher ..... A47G 29/1209 232/38
2006/0144918 A1 * 7/2006 Hutchinson ..... A47G 29/1214 232/35
2007/0103297 A1 * 5/2007 Armstrong ..... A47G 29/1207 340/539.22
2008/0109260 A1 * 5/2008 Roof ..... G06F 19/3406 705/3
2009/0201198 A1 * 8/2009 Moudy ..... G06Q 10/087 342/357.75
2009/0295541 A1 * 12/2009 Roof ..... G06F 19/3462 340/10.1
2010/0066536 A1 * 3/2010 Wainwright ..... A47G 29/1207 340/545.6
2012/0158606 A1 * 6/2012 Moudy ..... G06Q 10/083 705/332
2013/0147626 A1 6/2013 Hammoud
2014/0049993 A1 * 2/2014 Kelly ..... H02M 1/4225 363/44
2014/0278168 A1 * 9/2014 Rogers ..... G01R 31/3679 702/63
2015/0359372 A1 * 12/2015 Cho ..... A47G 29/1245 232/18
2015/0371468 A1 * 12/2015 Mackin ..... G06Q 10/0836 340/5.26
2016/0060008 A1 * 3/2016 Farentinos ..... B65D 43/16 220/211
2016/0278558 A1 * 9/2016 Ansari ..... H04W 4/12

* cited by examiner

MAILBOX WITH DETECTION MEANS

The present patent application for industrial invention relates to a detection unit for mailboxes.

Although the following description makes specific reference to a mailbox, the present invention is also extended to safe-deposit boxes or post-office boxes for banks and the like.

The present invention has been devised to solve a problem that has always impaired the use of mailboxes, which are checked daily in order to see if mail has been delivered by the postman.

Over the years mailboxes have been changed and developed from the aesthetic and functional viewpoint. As it is known, every building provides for installing at least one mailbox used by the postman to deliver mail, registered letters, bills or the like.

The first problem that has become more and more common is that an important notice may not be read promptly or may remain in the mail for too long, if the mailbox is not checked daily.

This problem can occur if the user does not open the mailbox every day to check the presence of mail.

Such an inconvenience can also occur when the person in charge of checking the mailbox is not in a condition to do it, being away for business or holiday reasons.

FR2868930 discloses a signaling device for mailboxes, exclusively of mechanical type, which informs the presence of mail by means of a wing that can be seen from a window of the mailbox.

DE152191 discloses a signaling device for mailboxes, exclusively of mechanical type.

US2013/14626 discloses a signaling device for mailboxes, of electronic type, provided with optical sensors to detect the mail, with lighting devices to signal the presence of mail, and with communication device to send messages to the user. Such a signaling device is impaired by some drawbacks, given the fact that the optical sensors are sensitive to environmental conditions and tend to get damaged in bad weather conditions. The system does not provide for any smart control logic intended to detect false signals. The system wastes a lot of electrical energy for operating. The system needs to be reset by the user every time the mail is collected.

The purpose of the present invention is to remedy the aforementioned drawbacks by devising a new detection unit for mailboxes that, when applied to a mailbox, informs the user that the mailbox is not empty.

The said unit is of electronic type and comprises a series of devices that, after being actuated, will send a text message or an email informing the presence of letters or the like in the mailbox.

For explanatory reasons the description of the detection unit according to the invention continues with reference to the attached drawings, which only have an illustrative, not limiting value, wherein.

Figure 1:
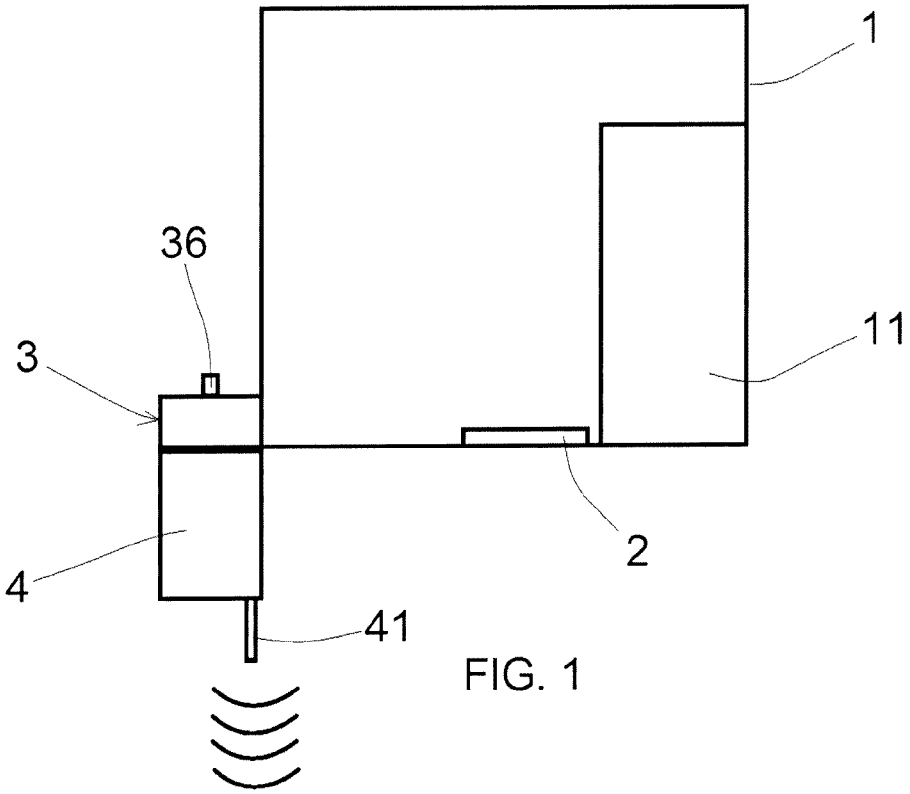
FIG. 1 is a diagrammatic block diagram that illustrates the unit of the invention.

Referring to FIG. 1, the detection unit for mailboxes comprising:

a mailbox (1);

detection means (2) provided inside said mailbox (1) to detect the presence of mail; and a warning device (3) operatively connected to the said detection means (2) to inform a user of the presence of mail in the said mailbox (1).

Fig. shows a detection unit according to the invention, wherein the warning device (3) is of electronic type. The detection unit comprises an electronic device (4) operatively connected to the said warning device (3) to send the user a warning signal of the presence of mail in the said mailbox (1).

The electronic device (4) is a communication module, comprising an antenna (41) to send a warning signal to the user when the detection means (2) detect the presence of mail in the mailbox (1).

The communication module (4) can be a cellular telephone module suitable for connecting to the Internet. Therefore the warning signal can be a text message or an email.

The warning device (3) also comprises a light source (37) that emits a light signal when the detection means (2) detect the presence of mail in the mail box (1). The light source (37) can be provided in correspondence of the mailbox (1) and/or in the house.

The detection means (2) are of electronic type and comprise detection sensors of magnetic type.

Figure 2:
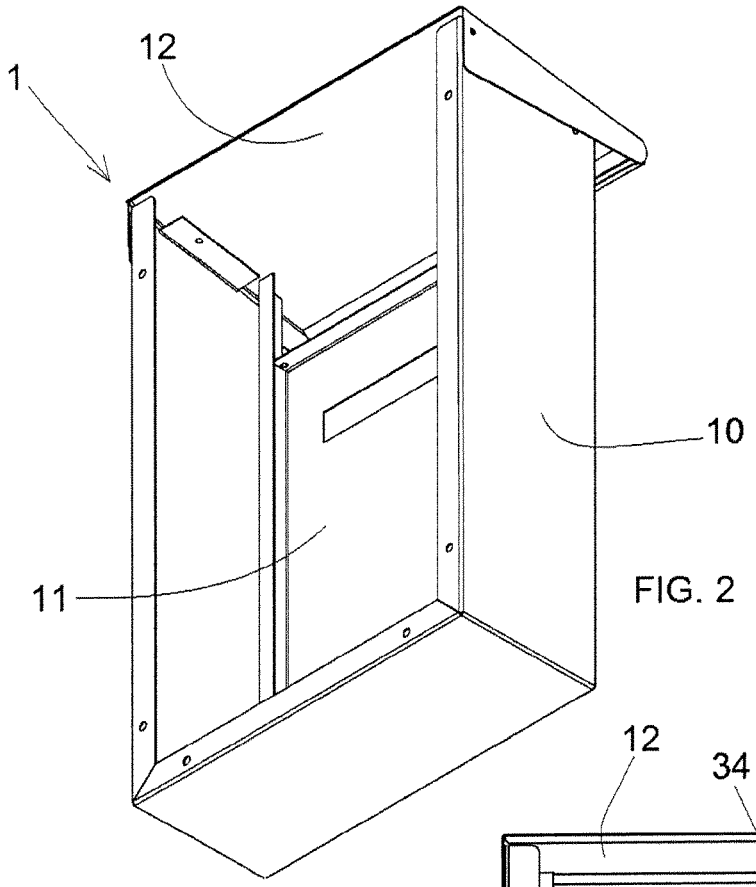
FIG. 2 is a perspective view of a mailbox.
Figure 3:
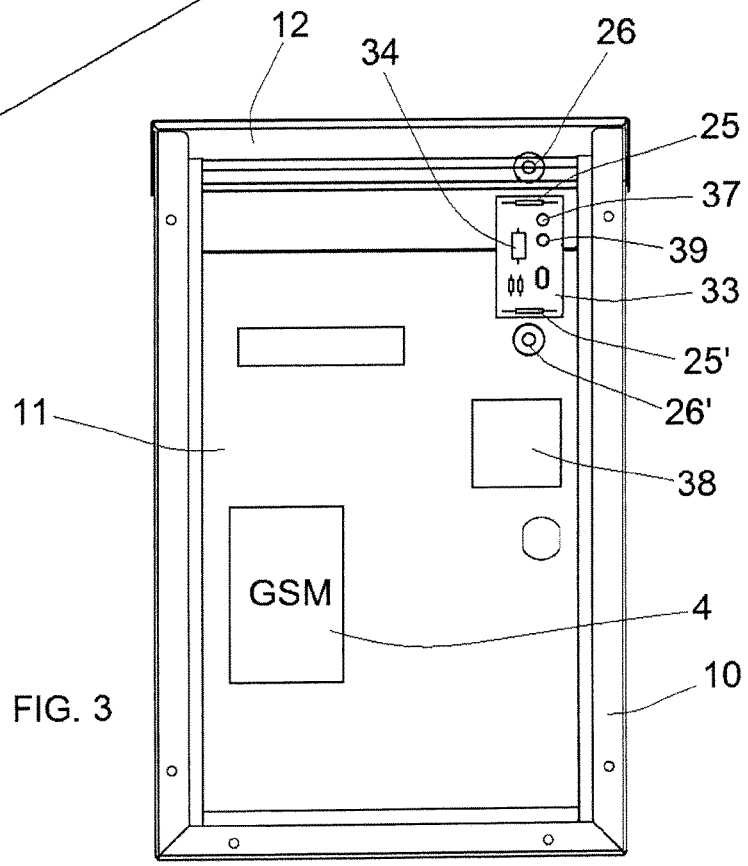
FIG. 3 is a rear view of the mailbox of FIG. 2 provided with the unit of the invention.

Referring to FIGS. 2 and 3, the mailbox comprises a box frame (10) that defines a compartment, a front door (11) and an oscillating door (12). The front door (11) is closed with a key and is opened by the user to collect the mail. The oscillating door (12) is opened by the postman to insert the mail.

The warning device (3) comprises a printed circuit board (33) whereon a suitably programmed microchip (34) is mounted. The printed circuit board (33) is fixed to the frame (10) and is disposed inside the compartment of the mailbox.

A first magnetic sensor (25) disposed in proximity to the oscillating door (12) and a second magnetic sensor (25') in proximity to the front door (11) are mounted in the printed circuit board (33). A first magnet (26) is fixed to the oscillating door (12) in proximity to the first magnetic sensor (25) and a second magnet (26') is fixed to the front door (11) in the proximity to the second magnetic sensor (25').

Low-energy consumption flashing LEDs (37) are mounted in the printed circuit board (33) to inform the presence of mail.

The electronic communication device (4) consisting in a GSM module connected to the chip (34) is mounted inside the compartment of the mailbox. A battery pack (38) is disposed in the compartment of the mailbox to power the electronic components mounted on the printed circuit board (33). A LED (39) is mounted on the printed circuit board (33) to inform that the battery pack (38) is exhausted. For illustrative purposes, the battery pack (38) comprises four 1.5V batteries. The GSM module (4) can be powered with a rechargeable battery or solar panel or 12V current.

Advantageously, each magnetic sensor (25, 25') is a Reed contact formed of two plates made of a ferromagnetic material and separated by a few tenth of millimeter. Contacts (generally made of diffused gold) are provided on the opposite plates. The plates are sealed inside a glass bulb filled with inert gas (nitrogen or argon). The ends of the plates (opposite to the contacts) come out of the bulb and are the terminals of the contact. In the presence of a magnetic field the plates become the seat of a magnetic flow and poles with opposite sign that tend to attract each other are formed. If the magnetic field is sufficiently strong (100-200 amperspire), the attraction force will overcome the cross-bending strength and the plates close the contact by attracting each other. In such a case, the magnetic sensors (25, 25') are protected by weather agents that may damage them.

The first magnetic sensor (25) detects the magnetic field of the first magnet (26) when the oscillating door (12) is closed. When the door (12) is open, the first sensor (25) does not detect the magnetic field of the first magnet (26); in such a case, the first magnetic sensor (25) sends the chip (34) a load signal that indicates the presence of mail.

When the chip (34) receives the load signal, the chip (34) turns on of the flashing LEDs (37) and sends a text message and/or email through the GSM module (4). Because of the provision of the chip (34) it is possible to power the flashing LEDs (37) with low energy, thus achieving energy saving.

The second magnetic sensor (25') detects the magnetic field of the second magnet (26') when the front door (11) is closed. When the front door (11) is open, the second sensor (25') does not detect the magnetic field of the second magnet (26); in such a case, the second magnetic sensor (25') sends the chip (34') an unload signal (that indicates that the user has collected the mail).

When the chip (34) receives the unload signal, the chip (34) turns off the flashing LEDs (37).

In order to prevent energy waste of the battery pack (38), if the oscillating door (52) remains open and therefore the first sensor (25) remains activated with the load signal, the chip (34) is programmed in such manner to compare the duration of the load signal with a predefined time interval, such as a few seconds. If the load signal remains for a time higher than the predefined time interval, the chip (34) resets the first sensor (25) in such manner that it no longer sends the load signal to the flashing LED (37), thus avoiding getting in conflict with the unload signal.

The invention claimed is:

1. A detection system comprising:

a mailbox having a frame and an oscillating door connected to said frame and a front door connected to said frame, said oscillating door adapted to be used by a mail carrier to insert mail into said mailbox, said front door adapted to be opened by a user to collect the mail;

a detector positioned in said mailbox so as to detect a presence of mail in said mailbox, said detector having a pair of magnetic sensors coupled respectively to magnets disposed in said oscillating door and said front door of said mailbox; and a warning device operatively connected to the said detector so as to inform the user of the presence of mail in the said mailbox, said warning device having a light signal and a telecommunication module, said telecommunication module adapted to send a text message or an email message to an electronic device of the user, said pair of magnetic sensors being mounted on a printed circuit board and connected to a chip that controls said light signal and said telecommunication module, said light signal being a flashing light-emitting diode powered by said battery pack through said chip, the pair of magnetic sensors sending a load signal to said chip when said oscillating door is opened and an unload signal when said front door is opened, said chip comparing a duration of the load signal with a predetermined time interval, said chip resetting when the duration of the load signal exceeds the predetermined time interval so as to reduce energy consumption of said battery pack if said oscillating door should remain opened.

2. The detection system of claim 1, each of said pair of magnetic sensors being a reed contact.

3. The detection system of claim 1, each of said pair of magnetic sensors comprising two plates of ferromagnetic material having a electrical contacts that are separated and sealed in a glass bulb filled with an inert gas, said two plates of ferromagnetic material having ends opposite to the contacts that protrude from said glass bulb so as to form contact terminals of the magnetic sensor.

4. The detection system of claim 1, further comprising:

another light-emitting diode mounted on said printed circuit board and connected to said chip so as to provide a humanly-perceivable signal when said battery pack is exhausted.

5. The detection system of claim 1, said communication module being a GSM cellular telephony module.

* * * * *